US006181053B1

(12) United States Patent
Roberts

(10) Patent No.: US 6,181,053 B1
(45) Date of Patent: Jan. 30, 2001

(54) THREE-KILOWATT XENON ARC LAMP

(75) Inventor: Roy D. Roberts, Hayward, CA (US)

(73) Assignee: EG&G ILC Technology, Inc., Sunnyvale, CA (US)

( * ) Notice: Under 35 U.S.C. 154(b), the term of this patent shall be extended for 0 days.

(21) Appl. No.: 09/301,641

(22) Filed: Apr. 28, 1999

(51) Int. Cl.[7] ..... H01J 1/02

(52) U.S. Cl. ..... 313/46; 313/570; 313/643; 313/634; 313/113

(58) Field of Search ..... 313/46, 113, 570, 313/634, 643

(56) References Cited

U.S. PATENT DOCUMENTS

| | | | | |
|---|---|---|---|---|
| 4,633,128 | | 12/1986 | Roberts et al. . | |
| 5,399,931 | * | 3/1995 | Robets | 313/46 |
| 5,721,465 | * | 2/1998 | Roberts | 313/46 |
| 5,789,863 | * | 8/1998 | Takahashi et al. | 313/113 X |
| 5,903,088 | * | 5/1999 | Sugitani et al. | 313/113 X |

* cited by examiner

*Primary Examiner*—Ashok Patel
(74) *Attorney, Agent, or Firm*—Thomas E. Schatzel; Law Offices of Thomas E. Schatzel

(57) ABSTRACT

An improved arc lamp with a ceramic body, an anode supported by a base, and a cathode suspended by a strut system opposite to the anode, and having an inside volume filled with xenon gas. The improvements include a groove in the ceramic body such that an angled area is presented to a head area of the anode that reduces heat coupling by radiation. A neck in the anode provides for a thermal choking such that a head portion of the anode will elevate in temperature during operation. A cavity is relieved in the base and all around the anode to provide a fixed means for managing the temperature of a head portion of the anode during operation. A stem portion of the cathode has a reduced diameter for attachment to the strut system and this provides reduced optical blockage. A base for the anode has a longer length than its diameter for improved heat transfer to an anode heatsink. A braze-ring recess is machined in an inner diameter of the base to help prevent a contamination of the surface of the anode facing the cathode with any braze material during manufacturing. A chamfer is cut in each of three legs in the strut system to reduce the tendency for electricity to arc-over to a reflector that surrounds the anode. A cathode heatsink surrounds a window sleeve supporting a lens and has an angled inside face for reducing lamp-thermal gradients. A waist-area heatsink is clamped-on the ceramic body in the gap on an outside surface between an anode heatsink and a cathode heatsink with enough clearance provided so that inter-heatsink electrical arcing does not occur.

11 Claims, 1 Drawing Sheet

THREE-KILOWATT XENON ARC LAMP

BACKGROUND OF THE INVENTION

1. Field of the Invention

Figure 1:
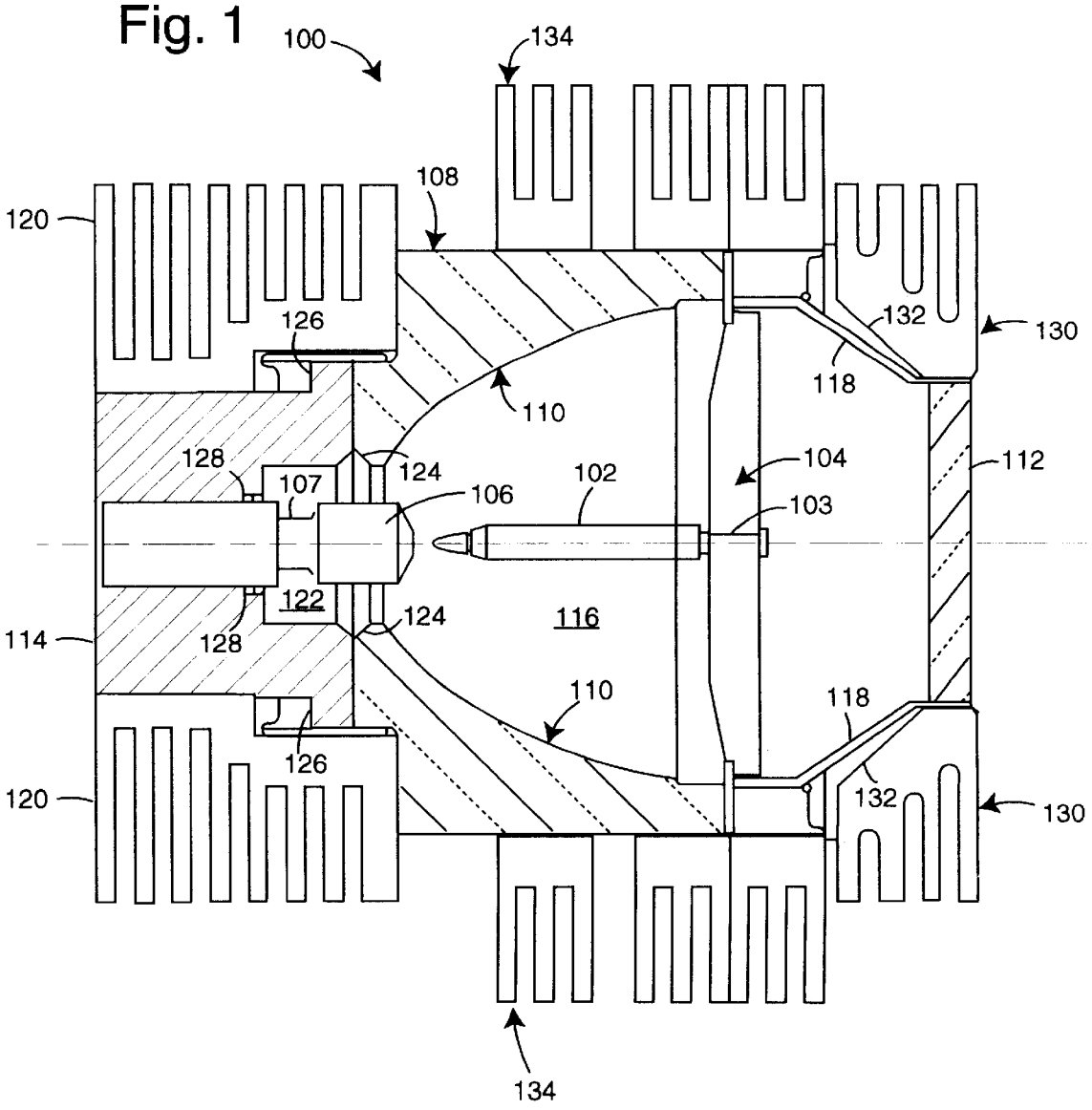

The invention relates generally to arc lamps and specifically to devices and methods used to cool the anode electrode of arc lamps.

2. Description of the Prior Art

Short arc lamps provide intense point sources of light that allow light collection in reflectors for applications in medical endoscopes, instrumentation and projection. Also, short arc lamps are used in industrial endoscopes, for example in the inspection of jet engine interiors.

A typical short arc lamp comprises an anode and a cathode positioned along the longitudinal axis of a cylindrical, sealed concave chamber that contains a gas pressurized to several atmospheres. U.S. Pat. 4,633,128, issued Dec. 30, 1986, to Roy D. Roberts, the present inventor, and Robert L. Miner, describes such a short arc lamp in which a copper sleeve member is attached to the reflecting wall to conduct heat from the reflecting wall through to the exterior wall and eventually to circulating ambient air.

The lamp illustrated in Roberts. et al., can be operated at one kilowatt. At higher power levels, the heat generated by an electric arc between the cathode and anode electrodes encounters thermal resistance to the surrounding areas which may result in overheating and potential failure. When too much power is applied to such lamps, thermal gradients within the ceramic lamp body may cause cracks and possibly a dangerous explosion of the lamp.

Conventional short arc lamps have solid anodes that tend to get very hot at the center of the face supporting the arc. If a portion of the electrode metal gets too hot, it vaporizes, and black deposits will form on the reflector. Such deposits reduce the reflector's ability to tend off heat absorption, and a catastrophic thermal runaway can develop.

At power levels of three thousand watts, heat management becomes the most limiting factor. A fine balance must always be struck between long lamp life and useful lamp output and efficiency.

SUMMARY OF THE PRESENT INVENTION

It is therefore an object of the present invention to provide a three-thousand watt xenon arc lamp.

It is another object of the present invention to provide a xenon arc lamp with improved lamp life.

Briefly, an embodiment of the present invention is an improved arc lamp with a ceramic body, an anode supported by a base, and a cathode suspended by a strut system opposite to the anode, and having an inside volume filled with xenon gas. The improvements include a groove in the ceramic body such that an angled area is presented to a head area of the anode that reduces heat coupling by radiation. A neck in the anode provides for a thermal choking such that a head portion of the anode will elevate in temperature during operation. A cavity is relieved in the base and all around the anode to provide a fixed means for managing the temperature of a head portion of the anode during operation. A xenon gas-fill volume of about seventeen cubic inches is used to improve lamp life for lamps operated at about three-thousand watts. A stem portion of the cathode has a reduced diameter for attachment to the strut system and this provides reduced optical blockage. A base for the anode has a longer length than its diameter for improved heat transfer to an anode heatsink. A braze-ring recess is machined in an inner diameter of the base to help prevent a contamination of the surface of the anode facing the cathode with any braze material during manufacturing. A chamfer is cut in each of three legs in the strut system to reduce the tendency for electricity to arc-over to a reflector that surrounds the anode. A cathode heatsink surrounds a window sleeve supporting a lens and has an angled inside face for reducing lamp-thermal gradients. This improves heat flow compared to more conventional straight-sided inside faces. A waist-area heatsink is clamped-on the ceramic body in the gap on an outside surface between an anode heatsink and a cathode heatsink with enough clearance provided so that inter-heatsink electrical arcing does not occur.

An advantage of the present invention is that a lamp is provided with a much longer life than conventional designs.

These and other objects and advantages of the present invention will no doubt become obvious to those of ordinary skill in the art after having read the following detailed description of the preferred embodiment which is illustrated in the drawing figure.

IN THE DRAWINGS

FIG. 1 is a cross-sectional view of a cylindrical-shaped, high-intensity short arc lamp embodiment of the present invention, and is oriented such that light will be emitted to the right in the drawing.

DETAILED DESCRIPTION OF THE PREFERRED EMBODIMENT

FIG. 1 illustrates a three-thousand watt xenon short-arc lamp embodiment of the present invention, referred to herein by the general reference numeral 100. The lamp 100 comprises a cathode 102 with a stem 103 supported by three-legged suspension strut system 104, an anode 106 with a neck 107, a ceramic body 108, an elliptical reflective surface mirror 110, a sapphire lens 112, and a copper base 114. The numerical aperture is about 1.6. The overall size is about six inches long and five inches in diameter at the widest point without heatsinks. The lens is about three inches in diameter.

The stem 103 has a reduced diameter compared to the rest of the cathode 102 so that the optical blockage to light output caused by the structure of the cathode and strut system is minimal.

An internal volume 116 is filled with xenon gas, and is about seventeen cubic inches. Such a large volume of xenon gas is unusual, but this is believed to be principally responsible for the long lamp life that has been demonstrated in tests of this design. A straight, simple conical window-sleeve sleeve 118 is a completely new design unlike prior art lower-power lamps which have a "bellows" portion.

The head of the anode 106 has a distinctive shape that is contoured to maintain a proper operating temperature at the arc interface. The overall construction prevents the anode from becoming too hot by providing a good heat path through the base 114 and an anode heatsink 120 which completely encircles it. The anode is generally constructed of tungsten, the base of copper and all the heatsinks of aluminum. The base 114 is longer in length than in diameter to provide better heat dissipation than prior art lamps.

A cavity 122 in the base 114 surrounds the anode neck 107 and provides a critical element in the temperature and heat control of the lamp 100. The dimensions of this cavity are empirically determinable. The radiated heat transfer from the anode 106 to the reflector 110 is minimized by a groove

124 with angled opposing faces that surrounds the head area of the anode. Such groove 124 reduces thermal stresses and cracking that would otherwise occur in the ceramic body 108.

The contact area between the base 114 and the ceramic body 108 is increased over prior art designs so that the heat flow out of the ceramic is improved. A flange 126 helps increase such contact area.

A braze-ring recess 128 is machined in the anode assembly to help prevent contaminating the surface of the anode facing the cathode with braze material during manufacturing.

Each leg in the three-legged suspension strut system 104 has a chamfer near the point it attaches to the body 108. Such relief is needed to increase the separation distance between the metal of the strut at cathode-voltage potential and the metal of the reflective surface mirror 110. Otherwise, arc-overs can become a severe problem during initial lamp striking that will prevent the formation of the proper arc between the tips of the cathode and anode.

A cathode heatsink 130 has an angled inside face 132 that reduces lamp-thermal gradients and improves the heat flow over more conventional straight-sided inside faces. A third, waist-area heatsink 134 is clamped-on the body 108 in the gap on the outside between the anode heatsink 120 and the cathode heatsink 130. Since the anode heatsink 120 and the cathode heatsink 130 are respectively at the electrical potentials of the anode and cathode electrodes 106 and 102, enough clearance must be provided so that inter-heatsink electrical arcing does not occur.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An improved arc lamp with a ceramic body, an anode supported by a base, and a cathode suspended by a strut system opposite to the anode, and having an inside volume filled with xenon gas, the improvements comprising:

a groove in said ceramic body such that an angled, non-parallel area is presented to a head area of said anode that reduces heat coupling by radiation.

2. The lamp of claim 1, further comprising:

a neck in said anode that provides for a thermal choking such that a head portion of said anode will elevate in temperature during operation.

3. The lamp of claim 1, further comprising:

a cavity relieved in said base and all around said anode and that provides a fixed means for managing the temperature of a head portion of said anode during operation.

4. The lamp of claim 1, further comprising:

a xenon gas-fill volume of about seventeen cubic inches that provides for an improved lamp life when operated at about three-thousand watts.

5. The lamp of claim 1, further comprising:

a stem portion of said cathode with a reduced diameter for attachment to said strut system and that thereby provides reduced optical blockage.

6. The lamp of claim 1, further comprising:

a base for said anode that has a longer length than its diameter and that thereby provides an improved heat transfer to an anode heatsink.

7. The lamp of claim 1, further comprising:

a braze-ring recess machined in an inner diameter of said base to help prevent a contamination of the surface of said anode facing said cathode with any braze material during manufacturing.

8. The lamp of claim 1, further comprising:

a chamfer in each of three legs in said strut system providing for a reduced tendency for electricity to arc-over to a reflector that surrounds said anode.

9. The lamp of claim 1, further comprising:

a cathode heatsink surrounding a window sleeve supporting a lens and with an angled inside face for reducing lamp-thermal gradients and thereby providing improved heat flow compared to more conventional straight-sided inside faces.

10. The lamp of claim 1, further comprising:

a waist-area heatsink that is clamped-on said ceramic body in the gap on an outside surface between an anode heatsink and a cathode heatsink with enough clearance provided so that inter-heatsink electrical arcing does not occur.

11. An improved arc lamp with a ceramic body, an anode supported by a base, and a cathode suspended by a strut system opposite to the anode, and having an inside volume filled with xenon gas, the improvements comprising:

a groove in said ceramic body such that an angled area is presented to a head area of said anode that reduces heat coupling by radiation;

a neck in said anode that provides for a thermal choking such that a head portion of said anode will elevate in temperature during operation;

a cavity relieved in said base and all around said anode and that provides a fixed means for managing the temperature of a head portion of said anode during operation;

a xenon gas-fill volume of about seventeen cubic inches that provides for an improved lamp life when operated at about three-thousand watts;

a stem portion of said cathode with a reduced diameter for attachment to said strut system and that thereby provides reduced optical blockage;

a base for said anode that has a longer length than its diameter and that thereby provides an improved heat transfer to an anode heatsink;

a braze-ring recess machined in an inner diameter of said base to help prevent a contamination of the surface of said anode facing said cathode with any braze material during manufacturing;

a chamfer in each of three legs in said strut system providing for a reduced tendency for electricity to arc-over to a reflector that surrounds said anode;

a cathode heatsink surrounding a window sleeve supporting a lens and with an angled inside face for reducing lamp-thermal gradients and thereby providing improved heat flow compared to more conventional straight-sided inside faces; and a waist-area heatsink that is clamped-on said ceramic body in the gap on an outside surface between an anode heatsink and a cathode heatsink with enough clearance provided so that inter-heatsink electrical arcing does not occur.

* * * * *